US010638901B2

(12) United States Patent
Yang et al.

(10) Patent No.: US 10,638,901 B2
(45) Date of Patent: May 5, 2020

(54) NOZZLE FOR CLEANER

(71) Applicant: LG ELECTRONICS INC., Seoul (KR)

(72) Inventors: Ingyu Yang, Seoul (KR); Jungwan Ryu, Seoul (KR); Jinhyouk Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 153 days.

(21) Appl. No.: 15/662,532

(22) Filed: Jul. 28, 2017

(65) Prior Publication Data

US 2018/0055313 A1 Mar. 1, 2018

(30) Foreign Application Priority Data

Aug. 25, 2016 (KR) ..... 10-2016-0108645

(51) Int. Cl.
*A47L 9/02* (2006.01)
*A47L 9/06* (2006.01)
(Continued)

(52) U.S. Cl.
CPC ..... *A47L 9/02* (2013.01); *A47L 9/0411* (2013.01); *A47L 9/0416* (2013.01);
(Continued)

(58) Field of Classification Search
CPC ..... A47L 9/02; A47L 9/0411; A47L 9/416; A47L 9/0427; A47L 9/0455;
(Continued)

(56) References Cited

U.S. PATENT DOCUMENTS 4,219,902 A 9/1980 Demaagd
6,323,570 B1 * 11/2001 Nishimura ..... A47L 5/28 15/392
(Continued)

FOREIGN PATENT DOCUMENTS

JP S59-130655 9/1984
JP 04044731 2/1992
(Continued)

OTHER PUBLICATIONS

Australian Office Action in Australian Application No. 2017314586, dated Nov. 4, 2019, 3 pages.

*Primary Examiner* — Dung Van Nguyen
(74) *Attorney, Agent, or Firm* — Fish & Richardson P.C.

(57) ABSTRACT

A nozzle includes: a housing having a chamber formed in the housing and a front opening formed on a front side of the housing; a rotation cleaning part accommodated in the chamber and to clean a floor; a partition member provided in the chamber to partition the chamber into two areas and of which at least a portion is in contact with the rotation cleaning part; a driving unit to rotate the rotation cleaning part; and a connection tube connected to the housing and configured to transfer air introduced through the front opening to a dust container of the cleaner, wherein a lower passage formed below the rotation cleaning part and an upper passage formed above the rotation cleaning part are provided in the chamber, and a portion of the partition member is recessed to define the upper passages.

20 Claims, 14 Drawing Sheets

(51) Int. Cl.
*A47L 9/04* (2006.01)
*A47L 9/00* (2006.01)

(52) U.S. Cl.
CPC ..... *A47L 9/0427* (2013.01); *A47L 9/0461* (2013.01); *A47L 9/0477* (2013.01); *A47L 9/066* (2013.01); *A47L 9/068* (2013.01); *A47L 9/00* (2013.01)

(58) Field of Classification Search
CPC .... A47L 9/0461; A47L 9/0477; A47L 9/0466; A47L 9/068; A47L 9/00
See application file for complete search history.

(56) References Cited

U.S. PATENT DOCUMENTS

| | | | | |
|---|---|---|---|---|
| 6,539,577 | B1 | 4/2003 | Okuda et al. | |
| 6,845,538 | B2 | 1/2005 | Nakamura | |
| 8,898,858 | B2 * | 12/2014 | Dyson | A47L 9/0411 15/375 |
| 9,750,380 | B2 | 9/2017 | McVey | |
| 9,949,605 | B2 * | 4/2018 | Isley | A47L 9/0411 |
| 10,004,370 | B2 * | 6/2018 | Isley | A47L 9/04 |
| 10,092,150 | B2 * | 10/2018 | Isley | A47L 9/0411 |
| 2013/0205539 | A1 | 8/2013 | Dyson et al. | |
| 2016/0183749 | A1 | 6/2016 | Isley et al. | |

FOREIGN PATENT DOCUMENTS

| | | |
|---|---|---|
| JP | 2986848 | 12/1999 |
| JP | 2000296082 | 10/2000 |
| JP | 2001-095735 | 4/2001 |
| JP | 2015-029911 | 2/2015 |
| JP | 2015-116414 | 6/2015 |
| KR | 10-2003-0086217 | 11/2003 |
| KR | 10-2010-0076147 | 7/2010 |
| KR | 10-2010-0076148 | 7/2010 |
| KR | 10-2014-0123091 | 10/2014 |
| KR | 10-2016-0036625 | 4/2016 |
| WO | 2015140525 | 9/2015 |

* cited by examiner

NOZZLE FOR CLEANER

CROSS-REFERENCE TO RELATED APPLICATIONS

This application claims priority under 35 U.S.C. 119 and 35 U.S.C. 365 to Korean Patent Application No. 10-2016-0108645 filed on Aug. 25, 2016 in Korea, the entire contents of which is hereby incorporated by reference in its entirety.

BACKGROUND

The present disclosure relates to a nozzle for a cleaner.

In general, a vacuum cleaner is a device that sucks air including dust using suction force generated by a suction motor mounted inside a cleaner body, and then filters the dust by a dust separator. Such a vacuum cleaner may be classified into a canister cleaner in which a suction nozzle configured to suck dust is provided separately from a body and is connected to the body by a connection device, an upright cleaner in which a suction nozzle is rotatably connected to a body and a handheld cleaner which is used in a state in which a user grips a body.

A agitator that is a rotation brush to which a brush is attached is installed in a suction nozzle for a vacuum cleaner according to the related art, and cleaning is performed while dust in a floor or a carpet is scratched as the agitator is rotated.

"A cleaner head for a vacuum cleaner" is disclosed in Korean Patent Application Publication No. 10-2014-0123091 as the prior art.

The cleaner head according to the prior art includes a brush bar provided in a chamber and a motor configured to drive the brush bar. The motor rotates the brush bar, and the brush bar strikes a surface to be cleaned while the brush bar is rotated. The motor is inserted into a brush bar.

Meanwhile, in the cleaner head according to the prior document, a phenomenon in which hairs or threads are entangled in the brush bar (rotation cleaning part) may occur, and accordingly a function of the brush bar deteriorates. Further, the cleaner head according to the prior art has a structure in which the motor is inserted into the brush bar, and is disadvantageous in cooling the motor.

SUMMARY

The present disclosure provides a nozzle for a cleaner, which may prevent a phenomenon in which hairs or threads are entangled in a rotation cleaning part, and may improve a cooling efficiency of a motor that is accommodated in the rotation cleaning part.

A nozzle for a cleaner includes: a housing having a chamber formed in the housing and a front opening formed on a front side of the housing; a rotation cleaning part which is accommodated in the chamber and cleans a floor through a rotation operation, and of which at least a portion is exposed through the front opening; a partition member which is provided in the chamber to partition the chamber into two areas and of which at least a portion is in contact with the rotation cleaning part; a driving unit inserted into the rotation cleaning part to rotate the rotation cleaning part; and a connection tube connected to the housing and configured to transfer air introduced through the front opening to a dust container of the cleaner, wherein a lower passage formed below the rotation cleaning part and upper passages formed above the rotation cleaning part are provided in the chamber, and portions of the partition member are recessed to define the upper passages.

BRIEF DESCRIPTION OF THE DRAWINGS

Embodiments will be described in detail with reference to the following drawings in which like reference numerals refer to like elements, and wherein.

DETAILED DESCRIPTION OF THE EMBODIMENTS

Figure 1:
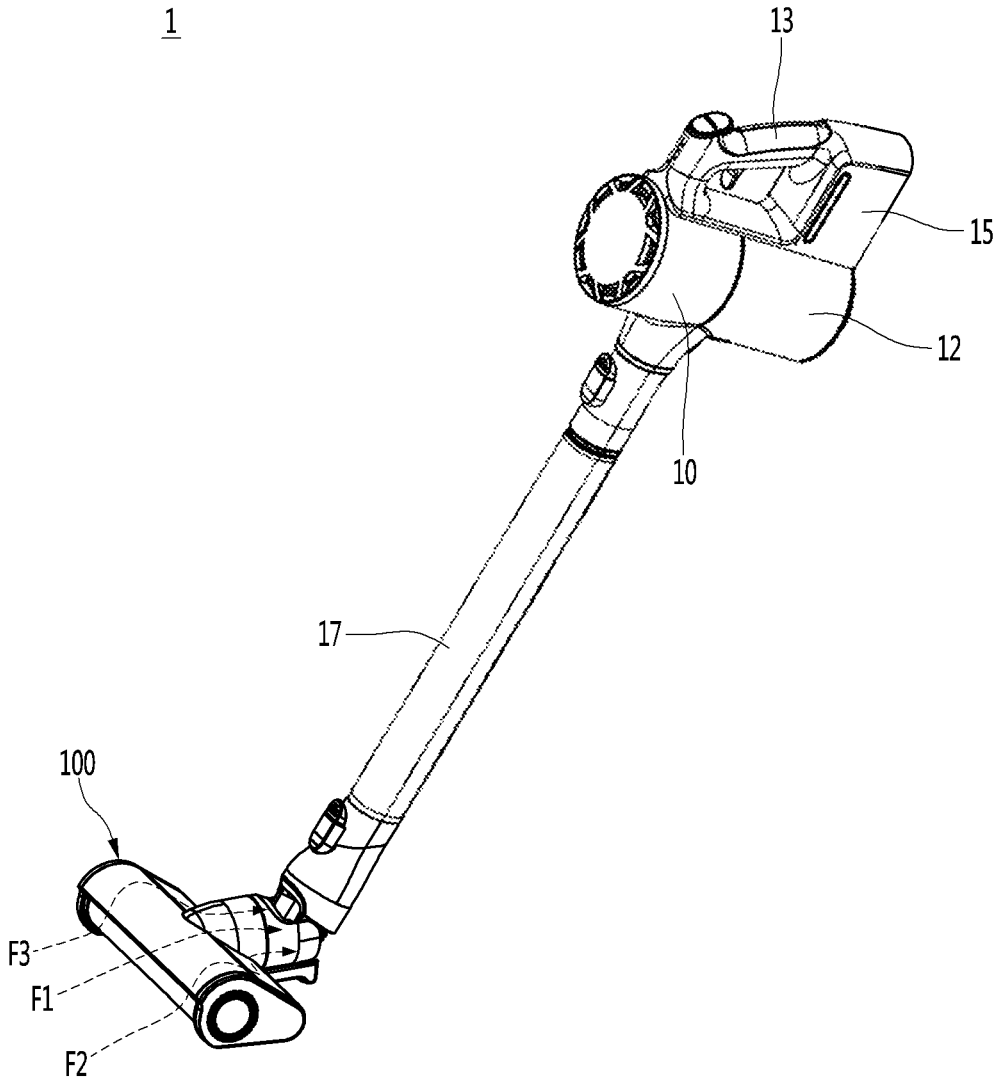
FIG. 1 is a perspective view illustrating a vacuum cleaner according to an embodiment of the present disclosure.

FIG. 1 is a perspective view illustrating a vacuum cleaner according to an embodiment of the present disclosure.

Referring to FIG. 1, a vacuum cleaner 1 according to an embodiment of the present disclosure may include a cleaner body 10 having a suction motor (not illustrated) configured to generate suction force, a suction nozzle 110 configured to suck air including dust and an extension tube 17 connecting the cleaner body 10 and the suction nozzle 100 to each other.

Meanwhile, although not illustrated, the suction nozzle 100 may be directly connected to the cleaner body 10 even without the extension tube 17.

The cleaner body 10 may include a dust container 12 in which the dust separated from the air is stored. Although not illustrated, a dust separator may be provided inside the cleaner body 10.

Accordingly, the dust introduced through the suction nozzle 100 is moved to the dust separator through the extension tube 17. Further, the dust separated from the dust separator may be stored in the dust container 12.

A handle 13 to be gripped by a user may be provided in the cleaner body 10. The user may perform cleaning while gripping the handle 13.

A battery (not illustrated) is provided in the cleaner body 10, and a battery accommodating part 15 in which the battery (not illustrated) is accommodated may be provided in the cleaner body 10. The battery accommodating part 15 may be provided below the handle 13. The battery (not illustrated) may be connected to the suction nozzle 100 to supply electric power to the suction nozzle 100.

Hereinafter, the suction nozzle 100 will be described in detail.

Figure 2:
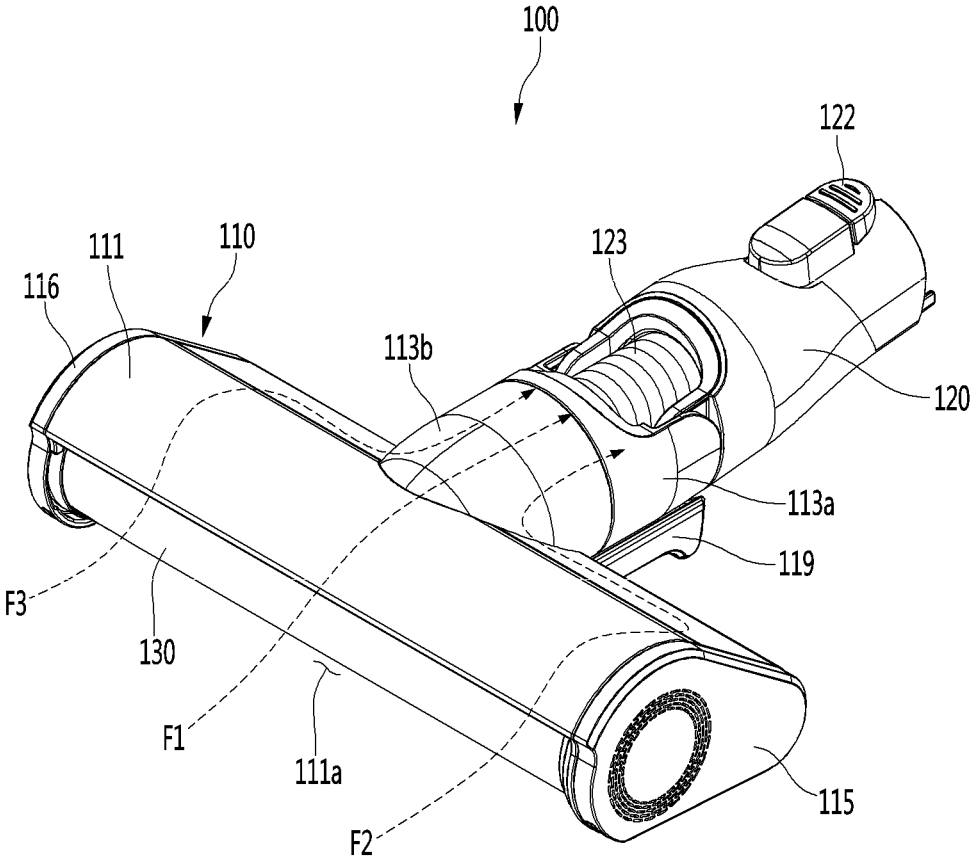
FIG. 2 is a perspective view illustrating a suction nozzle of FIG. 1.
Figure 3:
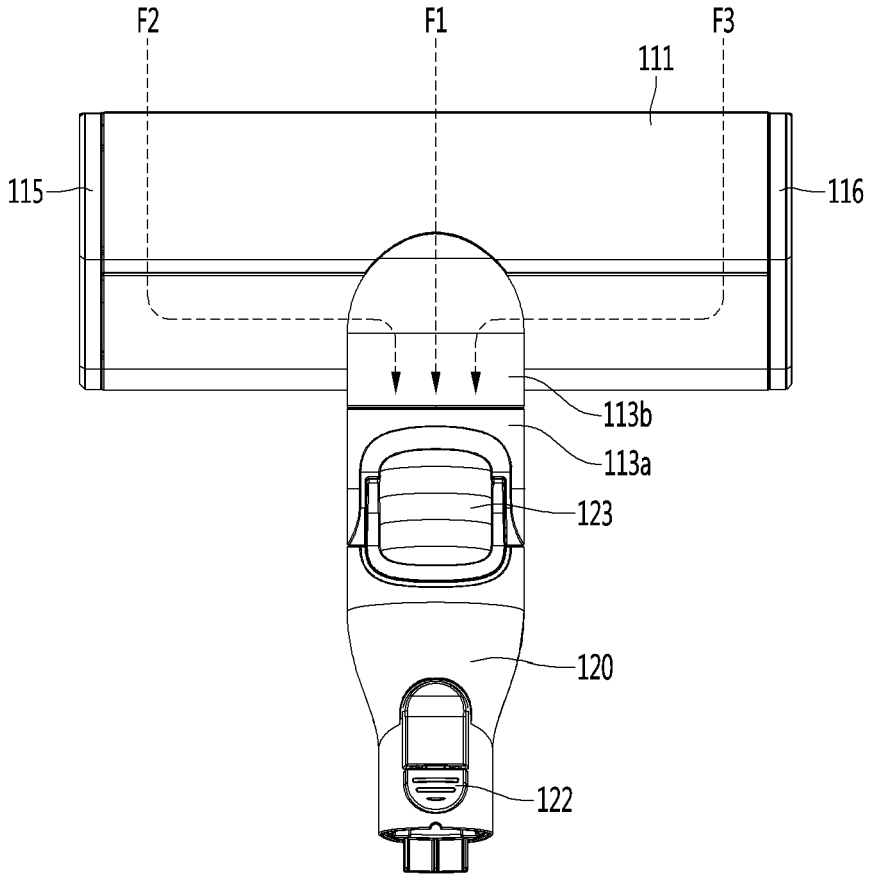
FIG. 3 is a plan view illustrating the suction nozzle of FIG. 2.
Figure 4:
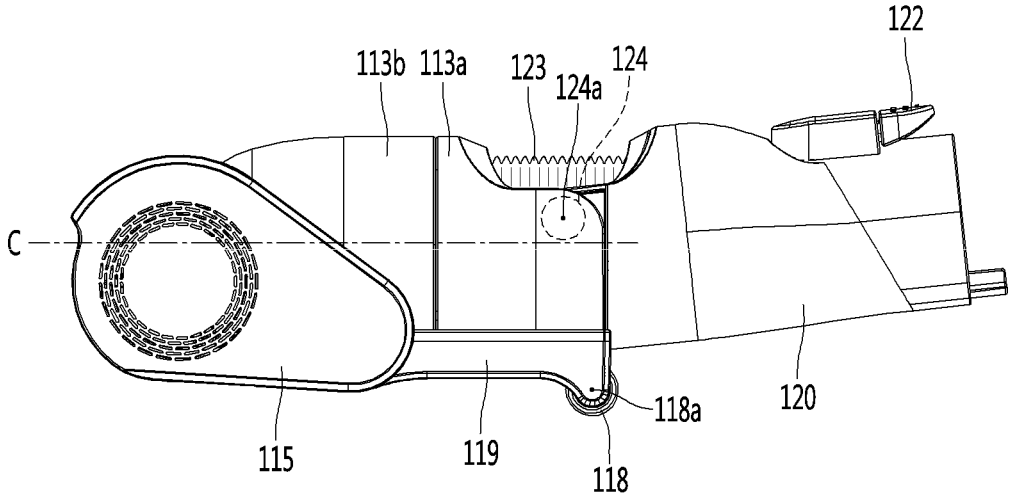
FIG. 4 is a side view illustrating the suction nozzle of FIG. 1.
Figure 5:
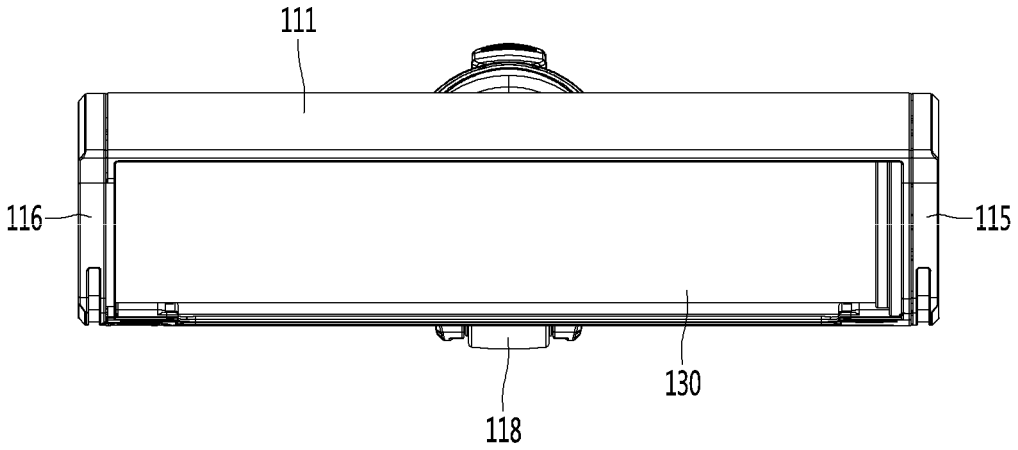
FIG. 5 is a front view illustrating the suction nozzle of FIG. 1.
Figure 6:
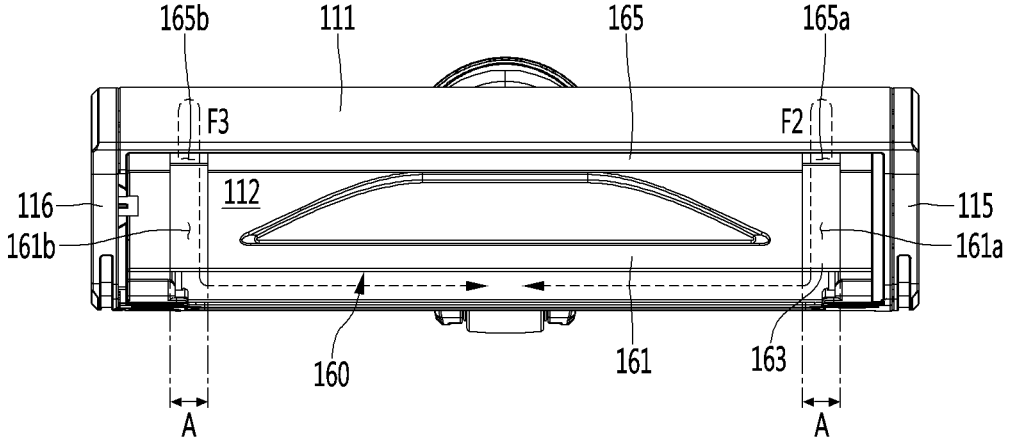
FIG. 6 is a view illustrating a state in which a rotation cleaning part is separated from the suction nozzle of FIG. 5.

FIG. 2 is a perspective view illustrating a suction nozzle of FIG. 1, FIG. 3 is a plan view illustrating the suction nozzle of FIG. 2, FIG. 4 is a side view illustrating the suction nozzle of FIG. 1, FIG. 5 is a front view illustrating the suction nozzle of FIG. 1, and FIG. 6 is a view illustrating a state in which a rotation cleaning part is separated from the suction nozzle of FIG. 5.

Figure 7:
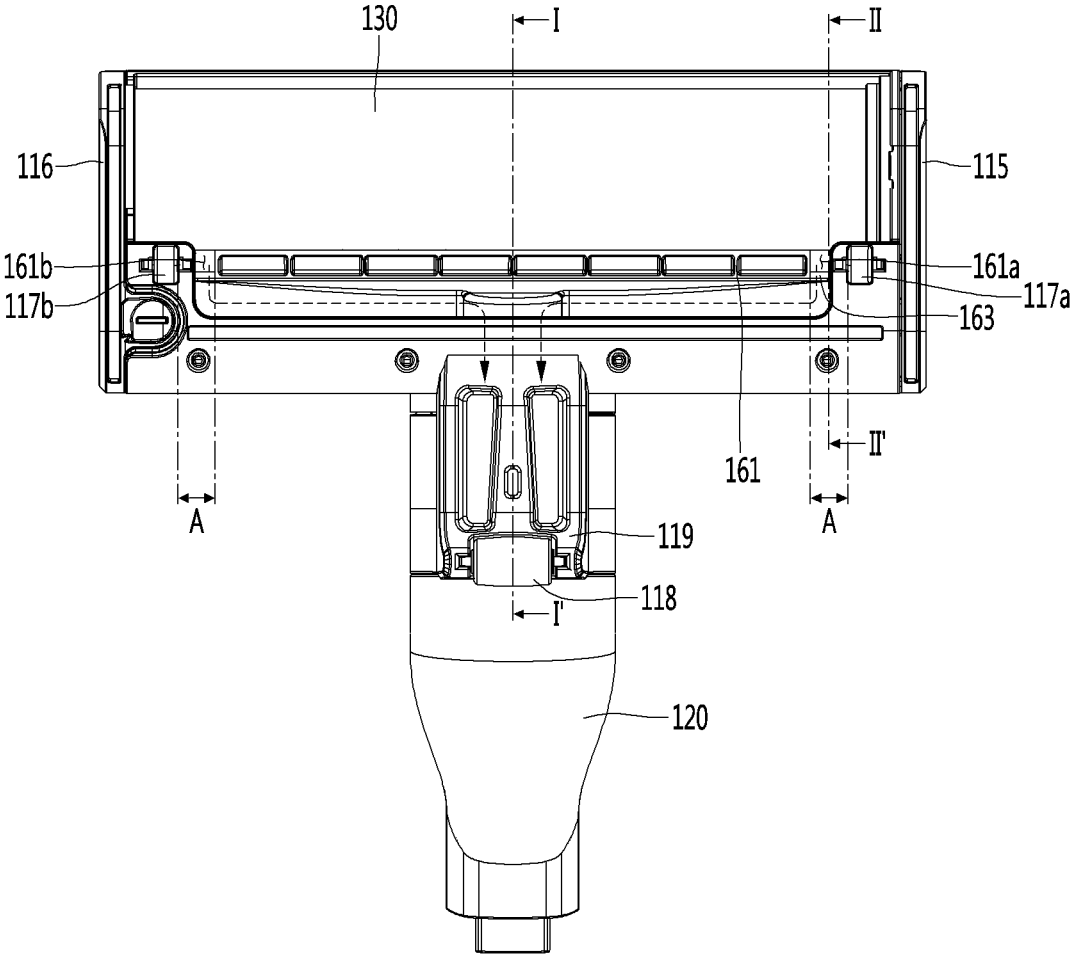
FIG. 7 is a bottom view illustrating the suction nozzle of FIG. 1.
Figure 8:
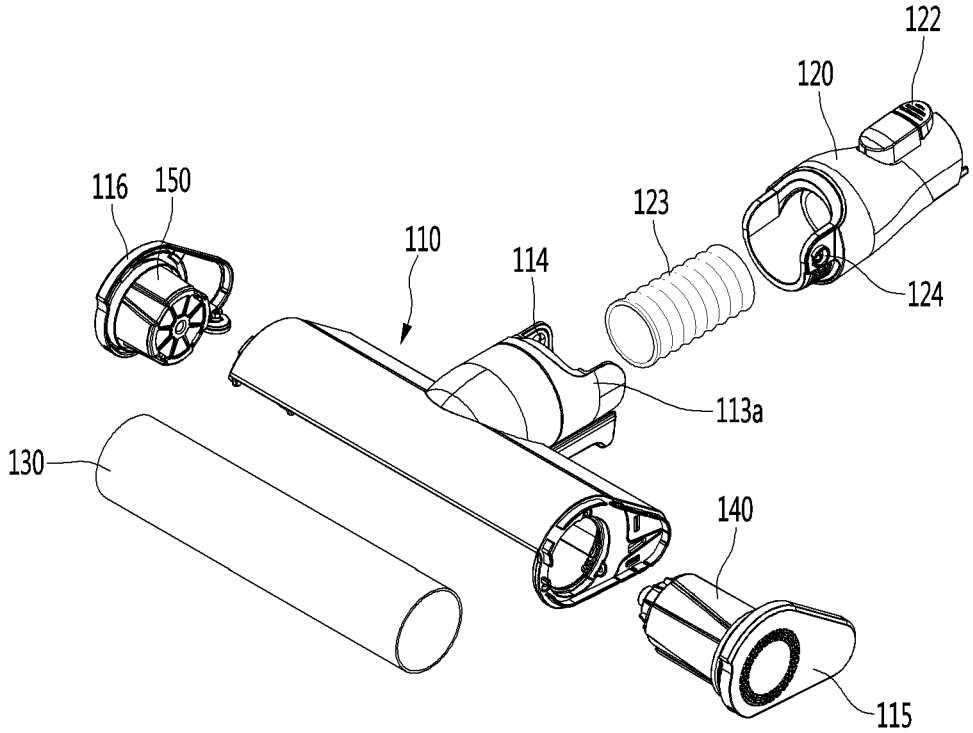
FIG. 8 is an exploded perspective view illustrating the suction nozzle of FIG. 1.
Figure 9:
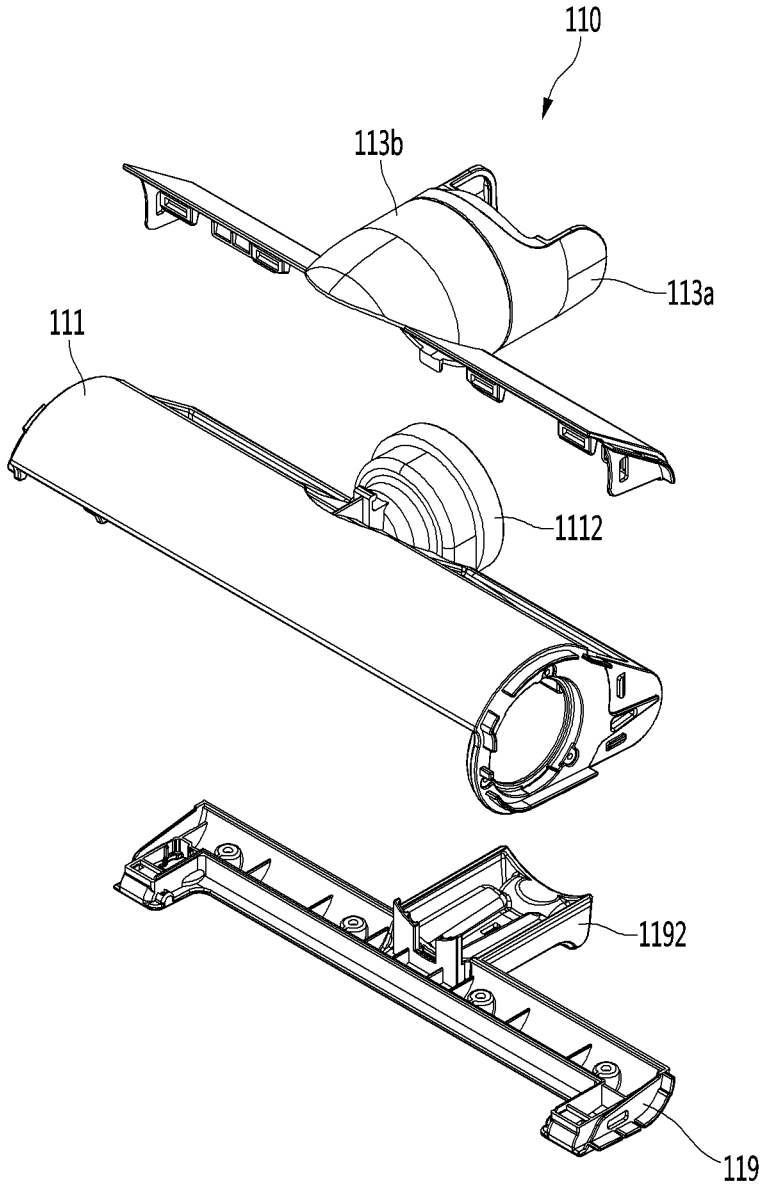
FIG. 9 is an exploded perspective view illustrating a housing.
Figure 10:
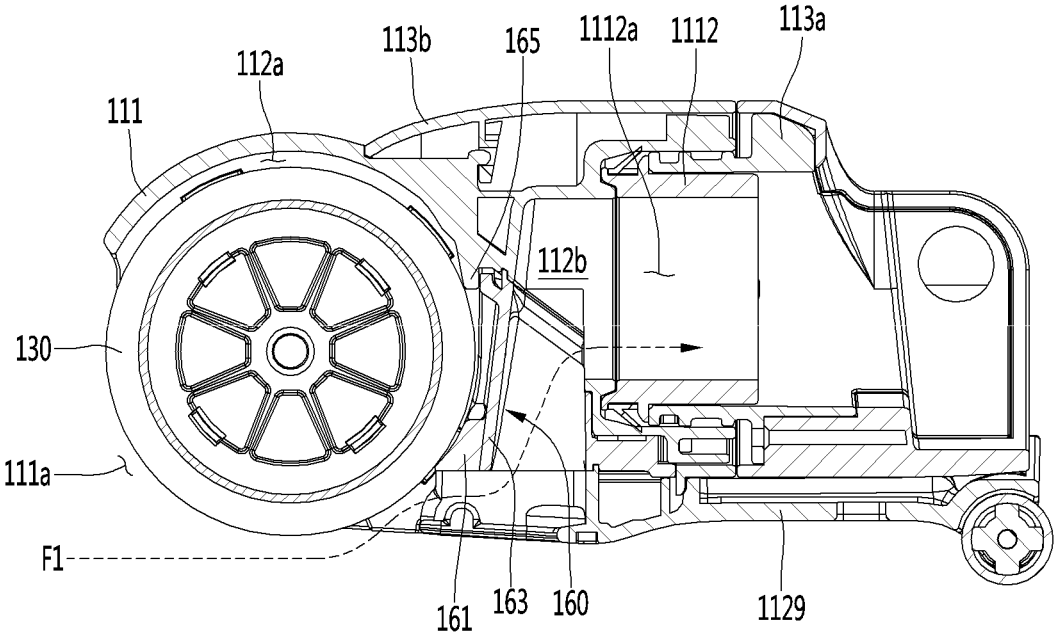
FIG. 10 is a sectional view illustrating the suction nozzle taken along line I-I' of FIG. 7.
Figure 11:
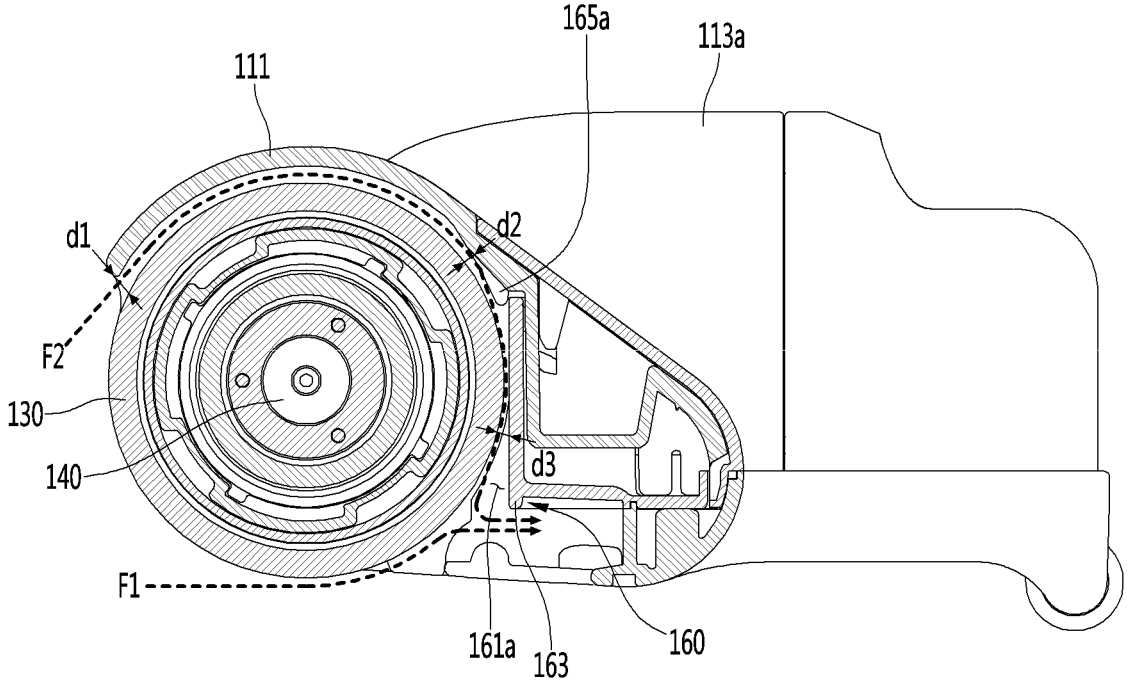
FIG. 11 is a sectional view taken along line II-II' of FIG. 7.

FIG. 7 is a bottom view illustrating the suction nozzle of FIG. 1, FIG. 8 is an exploded perspective view illustrating the suction nozzle of FIG. 1, FIG. 9 is an exploded perspective view illustrating a housing, FIG. 10 is a sectional view illustrating the suction nozzle taken along line I-I' of FIG. 7, and FIG. 11 is a sectional view taken along line II-II' of FIG. 7.

Referring to FIGS. 2 to 11, the suction nozzle 100 includes a housing 110, a connection tube 120 and a rotation cleaning part 130.

The housing 110 includes a body 111 in which a chamber 112 is formed. A front opening 111*a* configured to suck air including polluted substances may be formed in the body 111. Air introduced through the front opening 111*a* by suction force generated by the cleaner body 10 may be moved to the connection tube 120 via the chamber 112.

The front opening 111*a* extends in a left-right direction of the housing 110, and may extend to a front side of the housing 110 as well as a bottom surface of the housing 110. Accordingly, a suction area may be sufficiently ensured, so that a part of a floor, which is adjacent to a wall surface, may be uniformly cleaned.

The housing 110 may further include an inner tube 1112 communicating with the front opening 111*a*. External air may be moved to an inner passage 1112*a* of the inner tube 1112 via the front opening 111*a* by suction force generated by the cleaner body 10.

The housing 110 may further include a driving unit 140 configured to provide power for rotating the rotation cleaning part 130. The driving unit 140 may be inserted into one side of the rotation cleaning part 130 to transfer power to the rotation cleaning part 130. The driving unit 140 will be described in detail with reference to FIGS. 12 to 14.

The rotation cleaning part 130 may be accommodated in the chamber 112 of the body 111. At least a portion of the rotation cleaning part 130 may be exposed to the outside through the front opening 111*a*. The rotation cleaning part 130 may be rotated by driving force transferred through the driving unit 140 to rub against the floor so as to brush off the polluted substances. Further, an outer peripheral surface of the rotation cleaning part 130 may be formed of fabric such as flannel or a felt material. Accordingly, when the rotation cleaning part 130 is rotated, foreign substances such as dust, which is stacked on the floor, may be effectively removed by the rotation cleaning part 130.

The body 111 may cover at least a portion of an upper side of the rotation cleaning part 130. Further, an inner peripheral surface of the body 111 may be a curved shape to correspond to a shape of an outer peripheral surface of the rotation cleaning part 130. Accordingly, the body 111 may function to prevent the foreign substances, which is brushed off on the floor by rotating the rotation cleaning part 130, from being lifted up.

The housing 110 may further include side covers 115 and 116 configured to cover side surfaces of the chamber 112. The side covers 115 and 116 may be located on opposite side surfaces of the rotation cleaning part 130.

The side covers 115 and 116 include a first side cover 115 provided on one side of the rotation cleaning part 130 and a second side cover 116 provided on the other side of the rotation cleaning part 130. The driving unit 140 may be fixed to the first side cover 115.

The suction nozzle 100 further includes a rotation support 150 provided in the second side cover 116 to rotatably support the rotation cleaning part 130. The rotation support 150 may be inserted into the other side of the rotation cleaning part 130 to rotatably support the rotation cleaning part 130.

The rotation cleaning part 130 may be rotated in a counterclockwise direction with respect to the sectional view of FIG. 10. That is, the rotation cleaning part 130 is rotated to push foreign substances at a contact point between the rotation cleaning part 130 and the floor toward the inner tube 1112. Thus, the foreign substances brushed off by the rotation cleaning part 130 are moved to the inner tube 1112 and are sucked to the inner tube 1112 by suction force. The rotation cleaning part 130 may be rotated rearward with respect to the contact point between the rotation cleaning part 130 and the floor to improve cleaning efficiency.

A partition member 160 may be provided in the chamber 112. The partition member 160 may extend from an upper side to a lower side of the chamber 112 of the housing 110.

The partition member 160 may be provided between the rotation cleaning part 130 and the inner tube 1112. Accordingly, the partition member 160 may partition the chamber 112 of the housing 110 into a first area 112*a* in which the rotation cleaning part 130 is provided and a second area 112*b* in which the inner tube 1112 is provided. As illustrated in FIG. 10, the first area 112*a* may be provided in front of the chamber 112, and the second area 112*b* may be provided on a rear side of the chamber 112.

The partition member 160 may include a first extension wall 161. The first extension wall 161 may extend to be in contact with at least a portion of the rotation cleaning part 130. Thus, when the rotation cleaning part 130 is rotated, the first extension wall 161 may remove the foreign substances attached to the rotation cleaning part 130 through friction between the first extension wall 161 and the rotation cleaning part 130.

Further, the first extension wall 161 may extend along a rotation axis of the rotation cleaning part 130. That is, a contact point between the first extension wall 161 and the rotation cleaning part 130 may extend along the rotation axis of the rotation cleaning part 130. Thus, the first extension wall 161 may brush off the foreign substances attached to the rotation cleaning part 130 and may prevent the foreign substances on the floor from being introduced into the first area 112*a* of the chamber 112 as well. A phenomenon in which the foreign substances are discharged to a front side of the housing 110 through the front opening 111*a* by rotation of the rotation cleaning part 130 may be prevented by preventing the foreign substances from being introduced into the first area 112*a* of the chamber 112.

In addition, the first extension wall 161 may prevent a phenomenon in which hairs or threads are entangled in the rotation cleaning part 130, by preventing hairs or threads attached to the rotation cleaning part 130 from being introduced into the first area 112*a* of the chamber 112. That is, the first extension wall 161 may perform an anti-tangle function.

The partition member 160 may include a second extension wall 165. The second extension wall 165 may extend to be in contact with at least a portion of the rotation cleaning part 130, which is like the first extension wall 161. Thus, when the rotation cleaning part 130 is rotated, the second extension wall 165 may remove the foreign substances attached to the rotation cleaning part 130 through friction between the second extension wall 165 and the rotation cleaning part 130, which is like the first extension wall 161.

Meanwhile, the second extension wall 165 has the same function as that of the first extension wall 161. Further, because the foreign substances attached to the rotation cleaning part 130 may be brushed off only using the first extension wall 161 without the second extension wall 161, the second extension wall 165 may not be included in the housing 110.

The second extension wall 165 may be arranged to be higher than the first extension wall 161. Thus, the second extension wall 165 may function to secondarily separate the foreign substances that have not been separated by the first extension wall 161 in the rotation cleaning part 130.

Hereinafter, flow of air within the housing 110 will be described.

A plurality of suction passages F1, F2 and F3 through which external air is moved to an inner tube of the body 111 are formed in the body 111 of the suction nozzle 100.

The plurality of suction passages F1, F2 and F3 include a first lower passage F1 formed below the rotation cleaning part 130 and upper passages F2 and F3 formed above the rotation cleaning part 130.

The lower passage F1 is formed below the rotation cleaning part 130. In detail, the lower passage F1 is connected to the inner passage 1112*a* sequentially via the front opening 111*a*, a lower side of the rotation cleaning part 130 and the second area 112*b*.

The upper passages F2 and F3 are formed above the rotation cleaning part 130. In detail, the upper passages F2 and F3 are connected from the first area 112*a* via an upper side of the rotation cleaning part 130 and the second area 112*b* to the inner passage 1112*a*. Thus, the upper passages F2 and F3 may be joined to the lower passage F1 in the second area 112*b*.

The upper passages F2 and F3 include a first upper passage F2 formed on one side of the housing 110 and a second upper passage F3 formed on the other side of the housing 110. In detail, the first upper passage F2 is arranged adjacent to the first side cover 115 and the second upper passage F3 may be arranged adjacent to the second side cover 116.

To define the first upper passage F2, a first lower groove 161*a* may be formed in the first extension wall 161 and a first upper groove 165*a* may be formed in the second extension wall 165.

The first lower groove 161*a* is formed as an inner peripheral surface of the first extension wall 161, that is, a surface of the first extension wall 161, which is in contact with the rotation cleaning part 130, is recessed. Further, the first lower groove 161*a* may extend along a circumference direction of the rotation cleaning part 130.

The first upper groove 165*a* is formed as an inner peripheral surface of the second extension wall 165, that is, a surface of the second extension wall 165, which is in contact with the rotation cleaning part 130, is recessed. Further, the first upper groove 165*a* may extend along the circumference direction of the rotation cleaning part 130.

The first lower groove 161*a* and the first upper groove 165*a* are connected to each other and the first upper passage F2 is formed along the first lower groove 161*a* and the first upper groove 165*a*. Meanwhile, when the second extension wall 165 is not provided in the suction nozzle 100, the first upper passage F2 may be formed only using the first lower groove 161*a*.

Further, the first lower groove 161*a* and the first upper groove 165*a* may be arranged to surround the driving unit 140. Accordingly, the first upper passage F2 may be formed along a circumference of the driving unit 140 to surround at least a portion of the driving unit 140, and the driving unit 140 may be cooled by air flowing along the first upper passage F2.

Although left-right directional widths A of the first lower groove 161*a* and the first upper groove 165*a* may be identical to each other as illustrated, the present disclosure is not limited thereto. The left-right directional widths A of the first lower groove 161*a* and the first upper groove 165*a* may have a predetermined size. When the left-right directional widths A are small, a flow rate of the air may be reduced or flow of the air may be blocked as a width of the first upper passage F2 is reduced. Thus, a cooling performance of the driving unit 140 may be slight. In contrast, when the left-right directional widths A are large, a flow rate of the air may be increased but a hair anti-tangling function of the rotation cleaning part 130 by the first extension wall 161 and the second extension wall 165 may deteriorate as the width of the first upper passage F2 is increased. Thus, the left-right directional widths A may be formed to have an appropriate size, and may be formed to have a smaller width than a length of the driving unit 140. As an example, the left-right directional width A of the first upper groove 165*a* may be formed to have a width of 5-10 mm, but the present disclosure is not limited thereto.

As illustrated in FIG. 11, a spaced distance between an inner peripheral surface of the chamber 112 and an upper side of the rotation cleaning part 130 in the first upper passage F2 may be narrowed toward an inside of the chamber 112. In detail, a spaced distance between the inner peripheral surface of the chamber 112 and the upper side of the rotation cleaning part 130 may be formed to have d1 on a side of the first opening 111*a*, d2 in the first upper groove 165*a* and d3 in the first lower groove 161*a*. The d1 to d3 have smaller values as they go from d1 to d3 (d1>d2>d3). As an example, d1 may be 3 mm, d2 may be 2.7 mm and d3 may be 2 mm. Due to the above feature, the flow rate of the air on the upper side of the rotation cleaning part 130 may be reduced as it may become more adjacent to the front opening 111*a*. Accordingly, a phenomenon in which the foreign substances are discharged to a front side by rotation of the rotation cleaning part 130 may be suppressed.

Next, the second upper passage F3 will be described. To define the second upper passage F3, a second lower groove 161*b* is formed in the first extension wall 161 and a second upper groove 165*b* is formed in the second extension wall 165.

The second lower groove 161*b* is formed on the inner peripheral surface of the first extension wall 161, that is, the surface of the first extension wall 161, which is in contact with the rotation cleaning part 130, to be adjacent to the second side cover 116. The locations of the second lower groove 161*b* and the first lower groove 161*a* may be different from each other, and other components thereof are substantially identical to each other.

The second upper groove 165*b* is formed on the inner peripheral surface of the second extension wall 165, that is, the surface of the second extension wall 165, which is in contact with the rotation cleaning part 130, to be adjacent to the second side cover 116. The second upper groove 165*b* and the second lower groove 161*b* are connected to each other and the second upper passage F3 is formed along the second lower groove 161*b* and the second upper groove 165*b*. Meanwhile, when the second extension wall 165 is not provided in the suction nozzle 100, the second upper passage F3 may be formed only using the second lower groove 161*b*.

Further, the second lower groove 161*b* and the second upper groove 165*b* may be arranged to surround the rotation support 150. Accordingly, the second upper passage F3 may be formed along a circumference of the rotation support 150, and the rotation support 150 may be cooled by air flowing along the second upper passage F3.

Although left-right directional widths A of the second lower groove 161*b* and the second upper groove 165*b* may be identical to each other as illustrated, the present disclosure is not limited thereto. The left-right directional width A of the second lower groove 161*b* and the left-right directional width A of the second upper groove 165*b* may be formed to be identical to the left-right directional widths A of the first lower groove 161*a* and the first upper groove 165*a*.

A spaced distance between the inner peripheral surface of the chamber 112 and the upper side of the rotation cleaning part 130 in the second upper passage F3 may be narrowed toward an inside of the chamber 112, which is like the first upper passage F2. Detailed description thereof will be omitted.

The partition member 160 may further include a third extension wall 163 that is coupled to the first extension wall 161. The third extension wall 163 may be coupled to a rear surface of the first extension wall 161 to support the first extension wall 161. As the first lower groove 161*a* and the second lower groove 161*b* are formed in the first extension wall 161, a portion of the third extension wall 163 may be exposed to the first area 112*a* of the chamber 112.

In this way, as the lower passage F1 provided below the rotation cleaning part 130 and the first upper passage F2 provided above the rotation cleaning part 130 are provided in the housing 110, the driving unit 140 may be effectively cooled, and as the second upper passage F3 is provided in the housing 110, the rotation support 150 may be effectively cooled.

The connection tube 120 may connect the housing 110 and the extension tube 17 (see FIG. 1). That is, one side of the connection tube 120 is connected to the housing 110, and the other side of the connection tube 120 is connected to the extension tube 17.

A detachable button 122 configured to manipulate mechanical coupling with the extension tube 17 may be provided in the connection tube 120. The user may couple or separate the connection tube 120 and the extension tube 17 to or from each other by manipulating the detachable button 122.

The connection tube 120 may be rotatably connected to the housing 110. In detail, the connection tube 120 may be hinge-coupled to a first connection member 113*a* to be vertically rotatable.

Connection members 113*a* and 113*b* to be hinge-coupled to the connection tube 120 may be provided in the housing 110. The connection members 113*a* and 113*b* may be formed to surround the inner tube 1112. The connection members 113*a* and 113*b* may include a first connection member 113*a* and a second connection member 113*b* that are directly connected to the connection tube 120. One side of the second connection member 113*b* may be coupled to the first connection member 113*a* and the other side of the second connection member 113*b* may be coupled to the body 111.

As illustrated in FIG. 8, hinge holes 114 may be provided in the first connection member 113*a* and hinge shafts 124 inserted into the hinge holes 114 may be provided in the connection tube 120. However, unlike those illustrated, hinge holes may be formed in the connection tube 120 and hinge shafts may be formed in the first connection member 113*a*. The hinge holes 114 and the hinges shafts 124 may be collectively named a "hinge part".

A center 124*a* of each hinge shaft 124 may be arranged higher than a central axis C of the first connection member 113*a*. Accordingly, a rotational center of the connection tube 120 may be arranged higher than the central axis C of the first connection member 113*a*.

The first connection member 113*a* may be rotatably connected to the second connection member 113*b*. In detail, the first connection member 113*a* may be rotated about a longitudinal axis.

The suction nozzle 100 may further include an auxiliary hose 123 connecting the connection tube 120 and the inner tube 1112 of the housing 110. Accordingly, the air sucked to the housing 110 may be moved to the cleaner body 10 (see FIG. 1) via the auxiliary hose 123, the connection tube 120 and the extension tube 17 (see FIG. 1).

The auxiliary hose 123 may be formed of a flexible material to enable rotation of the connection tube 120. Further, the first connection member 113*a* may have a shape surrounding at least a portion of the auxiliary hose 123 to protect the auxiliary hose 123.

The suction nozzle 100 may further include front wheels 117*a* and 117*b* for moving during the cleaning. The front wheels 117*a* and 117*b* may be rotatably provided on the bottom surface of the housing 110. Further, the pair of front wheels 117*a* and 117*b* may be provided and may be arranged on a rear side of the front opening 111*a*.

The suction nozzle 100 may further include a rear wheel 118. The rear wheel 118 may be rotatably provided on the bottom surface of the housing 110 and may be arranged further behind the front wheels 117*a* and 117*b*.

The housing 110 may further include a support member 119 provided below the body 111. The support member 119 may support the body 111. The front wheels 117*a* and 117*b* may be rotatably coupled to the support member 119.

An extension part 1192 extending rearward may be provided in the support member 119. The rear wheel 118 may be rotatably coupled to the extension part 1192. Further, the extension part 1192 may support the first connection member 113*a* and the second connection member 113*b* on a lower side thereof.

A rotary shaft 118*a* of the rear wheel 118 may be arranged further behind the center 124*a* of the hinge shaft 124. Accordingly, stability of the housing 110 is improved, so that the housing 110 may be prevented from being overturned during the cleaning.

Hereinafter, detailed descriptions of the driving unit 140 will be described.

Figure 12:
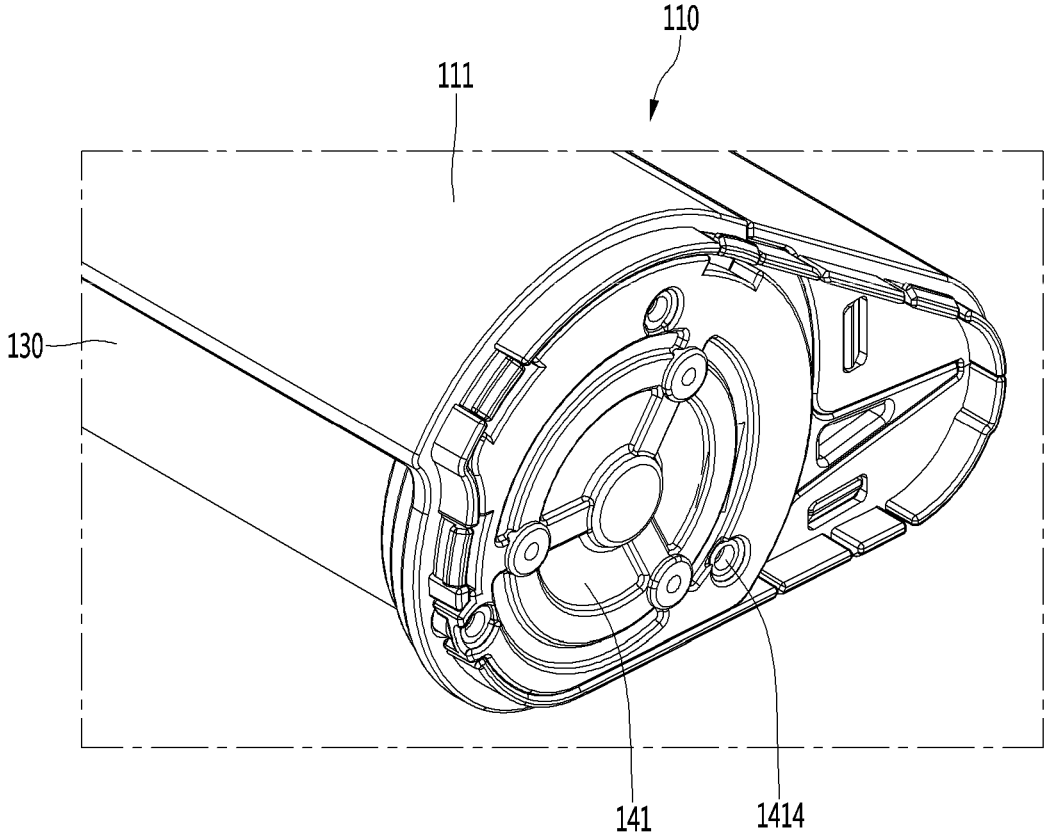
FIG. 12 is a view illustrating a state in which a first side cover of the suction nozzle is removed.
Figure 13:
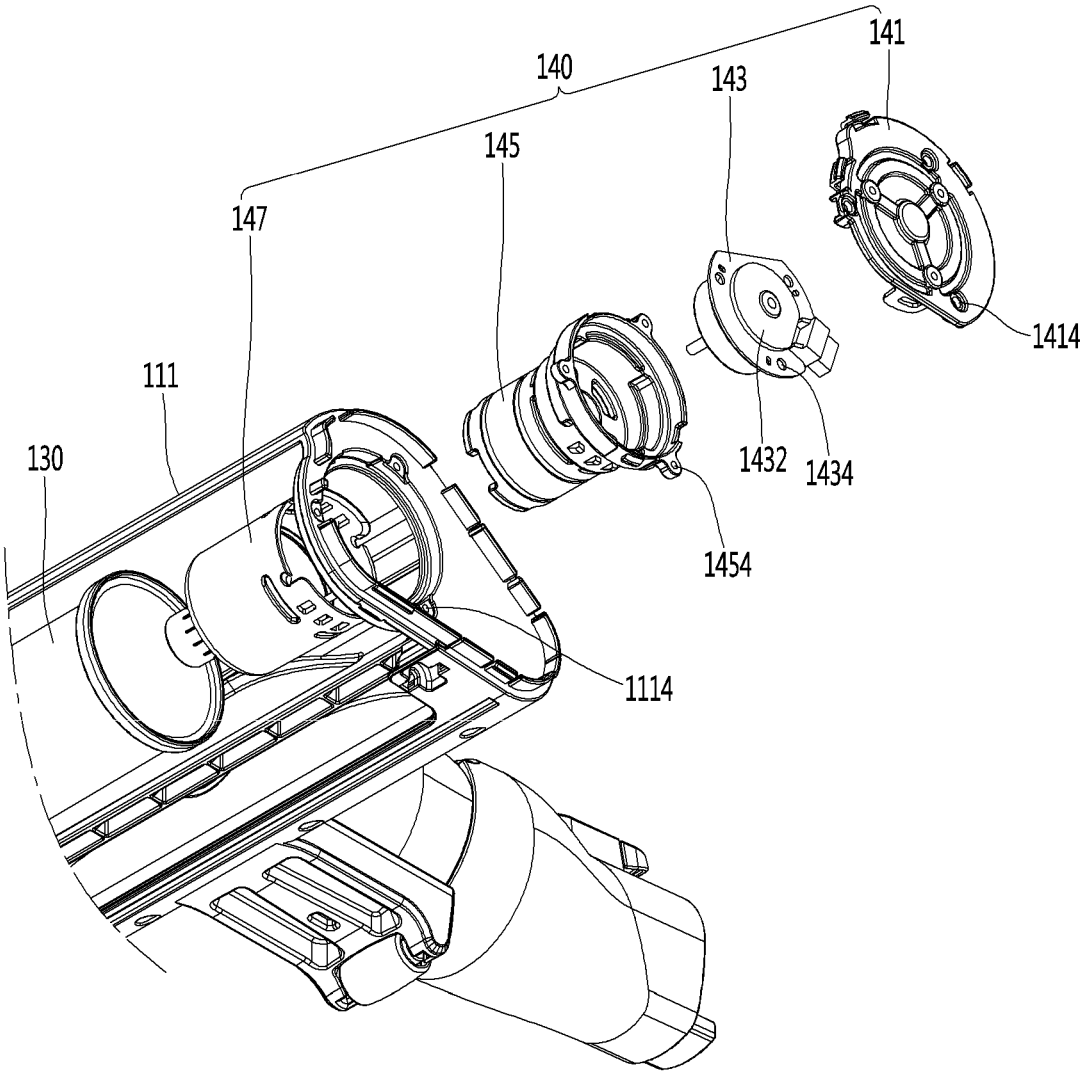
FIG. 13 is an exploded perspective view illustrating a driving unit.
Figure 14:
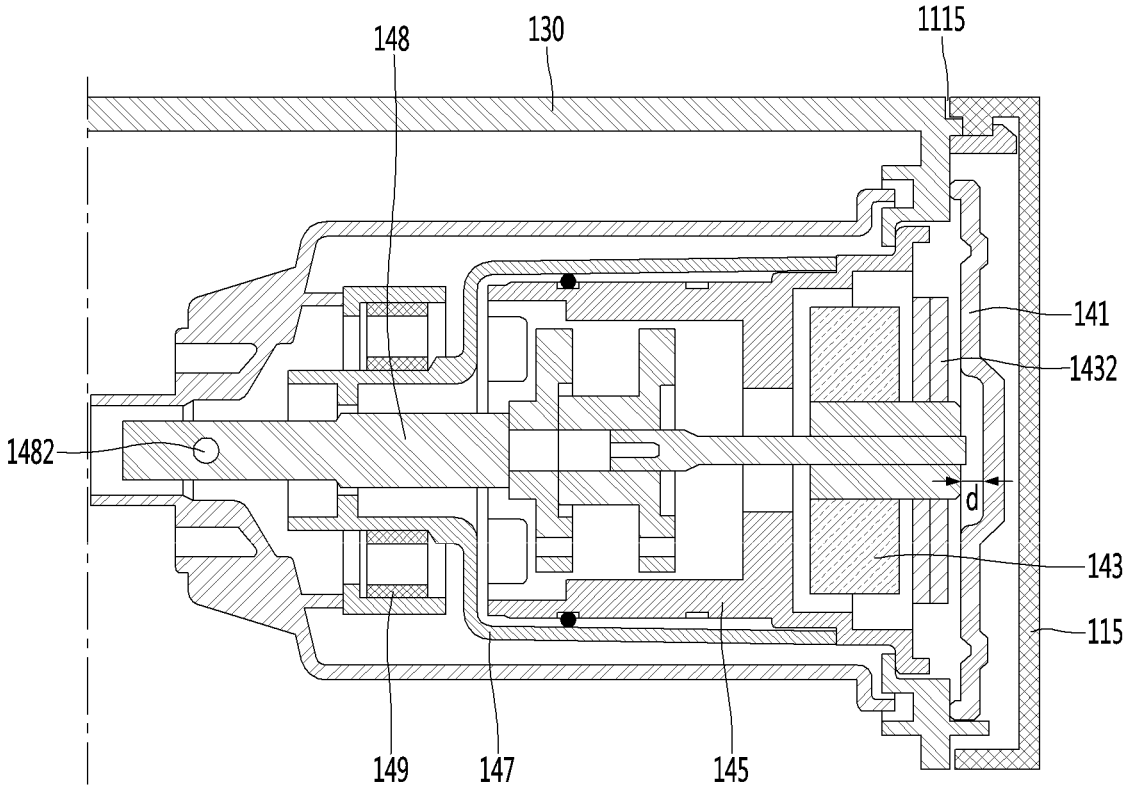
FIG. 14 is a sectional view taken along a rotation axis of the rotation cleaning part.

FIG. 12 is a view illustrating a state in which a first side cover of the suction nozzle is removed, FIG. 13 is an exploded perspective view illustrating a driving unit, and FIG. 14 is a sectional view taken along a rotation axis of the rotation cleaning part.

Referring to FIGS. 12 to 14, the driving unit 140 configured to rotate the rotation cleaning part 130 is coupled to the body 111 of the housing 110. At least a portion of the driving unit 140 may be inserted into one side of the rotation cleaning part 130.

The driving unit 140 includes a motor 143 configured to generate driving force and a motor supporter 141. The motor 143 may include a BLDC motor. A printed circuit board (PCB) 1432 configured to control the motor 143 may be provided on one side of the motor 143.

The motor 143 may be coupled to the motor supporter 141 by fastening members such as a bolt. Fastening holes 1434 for bolt-coupling with the motor supporter 141 may be formed in the motor 143.

The driving unit 140 may further include a gear unit 145 configured to transfer power of the motor 143.

The motor 143 may be inserted into the gear unit 145. To achieve this, a hollow hole may be formed inside the gear unit 145. The gear unit 145 may be bolt-coupled to the motor supporter 141, and to achieve this, fastening holes 1454 may be formed on one side of the gear unit 145. The gear unit 145, the motor 143 and the motor supporter 141 are integrally formed by fastening the gear unit 145 and the motor 143 to the motor supporter 141, so that vibrations generated while the motor 143 is operated may be reduced.

The motor supporter 141 may be formed of, for example, a polycarbonate material. The polycarbonate material may have an excellent insulation property and an impact resistance. Thus, the motor supporter 141 may be resistant to external shocks and may prevent static electricity generated in the outside from being transferred to the motor 143.

Further, an inner peripheral surface of the motor supporter 141 is spaced apart from the PCB 1432 of the motor 143. Accordingly, even when the static electricity generated in the body 111 is transferred to the driving unit 140, the static electricity fails to arrive at the PCB 1432 of the motor 143 and may be naturally discharged, so that the PCB 1432 of the motor 143 may be protected.

Further, the motor supporter 141 is spaced apart from an inner peripheral surface of the first side cover 115. Accordingly, a cooling passage configured to cool the driving unit 140 may be ensured.

The driving unit 140 may further include a cover 147 surrounding the gear unit 145. The cover 147 functions to protect the gear unit 145.

The driving unit 140 further include a shaft 148 connected to the gear unit 145, and the shaft 148 is connected to the rotation cleaning part 130. The shaft 148 may transfer driving force transferred through the gear unit 145 to the rotation cleaning part 130. Accordingly, the rotation cleaning part 130 may be rotated.

The driving unit 140 may further include bearings 149 installed in the cover 147. The bearings 149 may be connected to the shaft 148 to fix the shaft 148 to a predetermined location, and may rotate the shaft 148 while supporting a self-weight of the shaft 148 and a weight applied to the shaft 148. Accordingly, the shaft 148 may be smoothly rotated.

The shaft 148 includes a fixing member 1482 fixed to the rotation cleaning part 130. Accordingly, the shaft 148 may be rotated together with the rotation cleaning part 130 while being fixed to the rotation cleaning part 130. Thus, the shaft 148 may rotate the rotation cleaning part 130 using driving force transferred by the motor 143 and the gear unit 145.

According to the present disclosure, a plurality of extension walls in contact with a rotation cleaning part are provided in an inner chamber of a nozzle housing, so that dust stacked on the rotation cleaning part may be brushed off, and hairs or threads may be prevented from being entangled in the rotation cleaning part.

Further, in a suction nozzle according to the present disclosure, an upper passage formed above the rotation cleaning part is formed in the extension wall, so that a driving unit accommodated in the rotation cleaning part may be effectively cooled.

Further, in the suction nozzle according to the present disclosure, a connection tube connecting the housing and a cleaner body to each other is hinge-coupled to the housing, so that the user may smoothly perform cleaning, and the hinge is provided between the front wheels and the rear wheel of the suction nozzle, so that the suction nozzle may be prevented from being overturned during the cleaning.

What is claimed is:

1. A nozzle for a cleaner, the nozzle comprising:
a housing that defines a chamber and a front opening;
a rotation cleaning part that is accommodated in the chamber and configured to clean a floor by rotating against the floor, at least a portion of the rotation cleaning part being exposed through the front opening;
a connection tube that is connected to the housing and configured to guide air received through the front opening toward a dust container of the cleaner;
a partition member that is located inside the chamber and partitions the chamber into (i) a first area that receives the rotation cleaning part and (i) a second area that is configured to communicate with the connection tube, wherein the first area and the second area face opposite sides of the partition member, and at least a portion of the partition member contacts the rotation cleaning part; and
a driving unit that is inserted into the rotation cleaning part in a direction parallel with a longitudinal axis of the rotation cleaning part, the driving unit being configured to rotate the rotation cleaning part about the longitudinal axis,
wherein the housing defines:
a lower passage that is located vertically below the rotation cleaning part in the chamber, and
an upper passage that is located vertically above the longitudinal axis of the rotation cleaning part in the chamber, at least a portion of the upper passage being defined by a recessed portion of the partition member,
wherein the rotation cleaning part includes an outer peripheral surface spaced apart from an inner peripheral surface of the housing and configured to clean the floor, and
wherein the upper passage is defined between the outer peripheral surface of the rotation cleaning part and the inner peripheral surface of the housing.

2. The nozzle of claim 1, wherein the partition member comprises:
a first extension wall; and
a second extension wall that is located vertically above the first extension wall, and
wherein at least a portion of one or both of the first and second extension walls is configured to contact the rotation cleaning part.

3. The nozzle of claim 2,
wherein the first extension wall and the second extension wall are located in the first area.

4. The nozzle of claim 2, wherein the first extension wall defines a lower groove that is recessed from a portion of a surface of the first extension wall, the lower groove being in contact with the outer peripheral surface of the rotation cleaning part,
wherein the second extension wall defines an upper groove that is recessed from a portion of a surface of the second extension wall, the upper groove being in contact with the outer peripheral surface of the rotation cleaning part, and wherein the lower groove and the upper groove are connected to each other and form a portion of the upper passage.

5. The nozzle of claim 2, wherein the partition member extends downward from an upper surface of the chamber, and wherein the partition member further comprises a third extension wall that is configured to support the first extension wall.

6. The nozzle of claim 1, wherein the housing defines a pair of upper passages, each of the pair of upper passages being located, respectively, at opposite sides of the rotation cleaning part.

7. The nozzle of claim 1, wherein the upper passage is arranged to surround at least a portion of the driving unit.

8. The nozzle of claim 1, further comprising:

a front wheel that is located at a bottom surface of the housing and configured to guide the nozzle on the floor; and a rear wheel that is located at the bottom surface of the housing at a position rearward of the front wheel, wherein the connection tube includes a hinged portion that is located between the front and rear wheels.

9. The nozzle of claim 8, wherein the hinged portion includes hinge parts that are located vertically above a longitudinal axis of the connection tube.

10. The nozzle of claim 8, wherein the housing further comprises:

a body that accommodates the rotation cleaning part; and a support member that is located vertically below the body and configured to cover a bottom portion of the body, and wherein the front wheel and the rear wheel are located at the support member.

11. The nozzle of claim 10, wherein the housing further comprises an extension that extends rearward from a rear side of the body, and wherein the rear wheel is located at the extension.

12. The nozzle of claim 10, wherein the rear wheel includes a rotary shaft that is located rearward of a rotational center of the connection tube.

13. The nozzle of claim 12, wherein the hinged portion includes a hinge shaft about which the connection tube is configured to rotate.

14. The nozzle of claim 13, wherein the hinge shaft is located vertically above the rotary shaft of the rear wheel.

15. The nozzle of claim 13, wherein the hinge shaft and the rotary shaft of the rear wheel are parallel with the longitudinal axis of the rotation cleaning part.

16. The nozzle of claim 12, wherein the front wheel includes a plurality of front wheels, and wherein a rotation axis of each of the plurality of front wheels is parallel with the rotary shaft of the rear wheel.

17. The nozzle of claim 1, further comprising an inner tube that is located in the housing and configured to guide the air received through the front opening toward the connection tube.

18. The nozzle of claim 17, further comprising an auxiliary hose that connects the inner tube to the connection tube.

19. The nozzle of claim 1, wherein the housing comprises:

a body that defines the front opening and accommodates the rotation cleaning part; and a connection member that connects the body to the connection tube, and wherein the connection member includes hinge parts that rotatably couple the connection tube to the body.

20. The nozzle of claim 19, wherein the connection member comprises a first connection part that includes the hinge parts and a second connection part that is attached to the body, and wherein the first connection part is connected to the second connection part and configured to rotate about an axis of the first connection part.

* * * * *